US007430825B2

(12) United States Patent
Vanek et al.

(10) Patent No.: US 7,430,825 B2
(45) **Date of Patent: *Oct. 7, 2008**

(54) MULTI-SHOT RING AIRFOIL PROJECTILE LAUNCHER

(75) Inventors: Chester Vanek, Sunnyvale, CA (US); Abraham Flatau, Palo Alto, CA (US)

(73) Assignee: Flatau & Vanek, LLC, BelAir, MD (US)

( * ) Notice: Subject to any disclaimer, the term of this patent is extended or adjusted under 35 U.S.C. 154(b) by 144 days.

This patent is subject to a terminal disclaimer.

(21) Appl. No.: 11/369,166

(22) Filed: Mar. 6, 2006

(65) Prior Publication Data

US 2007/0079819 A1 Apr. 12, 2007

Related U.S. Application Data

(63) Continuation of application No. 10/727,434, filed on Dec. 3, 2003, now Pat. No. 7,007,424, which is a continuation of application No. 10/172,030, filed on Jun. 13, 2002, now Pat. No. 6,671,989.

(60) Provisional application No. 60/299,045, filed on Jun. 18, 2001.

(51) Int. Cl.
*F41A 3/00* (2006.01)

(52) U.S. Cl. ..... 42/18; 42/105; 89/14.6; 102/503

(58) Field of Classification Search ..... 42/105, 42/11, 16, 17, 18; 89/14.6, 194, 196; 102/502, 102/503, 520
See application file for complete search history.

(56) References Cited

U.S. PATENT DOCUMENTS 3,740,884 A 6/1973 Wilhelm
3,815,271 A 6/1974 Lynn
3,877,383 A * 4/1975 Flatau ..... 102/503
3,898,932 A 8/1975 Flatau et al.
3,919,799 A * 11/1975 Austin et al. ..... 42/105
3,951,070 A 4/1976 Flatau et al.
3,980,023 A 9/1976 Misevich
3,982,489 A 9/1976 Flatau et al.
4,019,424 A * 4/1977 Reynolds ..... 89/137
4,022,103 A * 5/1977 Schmidt ..... 89/14.6
4,154,012 A 5/1979 Miller
4,190,476 A * 2/1980 Flatau et al. ..... 156/218
4,212,244 A 7/1980 Flatau
4,270,293 A * 6/1981 Plumer et al. ..... 42/105
4,296,564 A * 10/1981 Oberst ..... 42/1.04
4,301,736 A 11/1981 Flatau et al.
4,337,911 A 7/1982 Flatau (Continued)

*Primary Examiner*—Michelle Clement
(74) *Attorney, Agent, or Firm*—Weide & Miller, Ltd.

(57) ABSTRACT

The invention is a multi-shot launcher adapted to launch ring airfoil projectiles. Each ring airfoil projectile is coupled to a sabot, the ring airfoil projectile and sabot mounted to a housing in a cartridge form. The cartridge has a length which is less than its diameter. The launcher includes a receiver defining a cartridge receiving area and a tubular passage through which the ring airfoil is launched from a fired cartridge. The launcher includes a trigger mechanism for firing a cartridge. The launcher includes an ejector for ejecting the housing of a spent cartridge from the receiving area and a loader for loading a new cartridge into the receiving area. The cartridge may be loaded from a magazine connected to the receiver.

15 Claims, 8 Drawing Sheets

U.S. PATENT DOCUMENTS

| | | | | | |
|---|---|---|---|---|---|
| 4,497,239 | A | * | 2/1985 | Curry | 89/198 |
| 4,527,459 | A | * | 7/1985 | Childers | 89/161 |
| 4,539,911 | A | | 9/1985 | Flatau | |
| 4,753,152 | A | | 6/1988 | Baechler | |
| 5,235,769 | A | | 8/1993 | Stead et al. | |
| 5,239,911 | A | | 8/1993 | Ostor | |
| 5,367,810 | A | | 11/1994 | Stead et al. | |
| 5,515,787 | A | * | 5/1996 | Middleton | 102/503 |
| 5,970,970 | A | | 10/1999 | Vanek et al. | |
| 6,101,919 | A | | 8/2000 | Murello | |
| 6,647,890 | B2 | | 11/2003 | Findlay | |
| 6,671,989 | B2 | | 1/2004 | Vanek et al. | |
| 7,007,424 | B2 | | 3/2006 | Vanek et al. | |

* cited by examiner

MULTI-SHOT RING AIRFOIL PROJECTILE LAUNCHER

RELATED APPLICATION DATA

This application is a continuation of U.S. patent application Ser. No. 10/727,434, filed Dec. 3, 2003, now U.S. Pat. No. 7,007,424, which is a continuation of U.S. patent application Ser. No. 10/172,030, filed Jun. 13, 2002, now U.S. Pat. No. 6,671,989, which claims priority to U.S. Provisional Application Ser. No. 60/299,045, filed Jun. 18, 2001.

FIELD OF THE INVENTION

The present invention is related to ring airfoil projectile launchers.

BACKGROUND OF THE INVENTION

The ring airfoil projectile (RAP) has unique aerodynamic characteristics: high lift, and low drag. By spinning the ring airfoil at launch, gyroscopic stability results, and relatively flat trajectories with extended range are achievable.

The initial application of the ring airfoil in a self-contained munition appeared in the early 1970's (see U.S. Pat. No. 3,877,383 to Flatau). This early configuration was designed as high-explosive fragmentation projectile. Shortly thereafter, several designs appeared for use as a less-than-lethal (LTL) projectile by making the ring airfoil body of a rubber-like material and incorporating cavities to contain chemical-incapacitation agents (see U.S. Pat. Nos. 3,898,932, 3,951,070, and 4,190,476 to Flatau). Upon target impact, the LTL RAP dispersed its load of agent on and about the target.

To date, all of the launchers associated with LTL ring airfoil projectile have been single-shot devices (see U.S. Pat. No. 4,154,012 to Miller and U.S. Pat. No. 5,970,970 to Vanek). Hence, the design of the subject launcher as semi-automatic or repeating mechanism is a progressive step in the technology of launching spinning ring airfoil projectiles, particularly for LTL use.

SUMMARY OF THE INVENTION

This invention addresses the need for a repeating launcher for ring airfoil projectiles, including as a non-lethal means of riot-control and the subduction of belligerence, for use when law officials deem the use of lethal force counterproductive.

In one embodiment, the launcher is particularly adapted to using a novel cartridge enclosing the RAP. The cartridge comprises a housing which contains the RAP mounted to a sabot. The cartridge is cylindrical in shape, having a diameter which exceeds its length.

The launcher includes a receiver or body defining a cartridge receiving area and a tubular passage through which the ring airfoil projectile is launched from a fired cartridge. The launcher includes a trigger mechanism for firing a cartridge. The launcher includes an ejector for ejecting the housing of a spent cartridge from the receiving area and a loader for loading a new cartridge into the receiving area. The cartridge may be loaded from a magazine connected to the receiver.

In one embodiment, the launcher is manually operated in order to successively fire ring airfoil projectiles. In this embodiment, the trigger mechanism is connected to a breechblock which is movably mounted in a chamber of the receiver. An ejector bar is connected to the breechblock. In one embodiment, a pin connected to the ejector bar resides in a track defined in the breechblock. When the breechblock is moved from a forward to a retracted position, such as by actuation of a pistol-grip mechanism connected to the breechblock and extending from the receiver and moveable with respect to the receiver, the ejector bar is drawn downwardly and ejects the housing of a spent cartridge through an opening in the body of the launcher.

In another embodiment, the launcher is semi-automatic without the need of the user to manually cause cartridge load and ejection. In this embodiment, movement of the breechblock is effected by gas pressure resulting from the firing of a cartridge. The breechblock is moved automatically back to a firing position through the use of a return spring.

In one embodiment, a load follower is connected to the ejector bar. The load follower is drawn downwardly along with the ejector bar when the breechblock is moved rearwardly. The load follower pulls an unspent cartridge into the receiving area for firing.

In one embodiment, the launcher includes a sabot stripper. The sabot stripper is located at the end of the launch passage opposite the receiving area. In one embodiment, the sabot stripper comprises a ring having a reduced dimension compared to the launch passage. The sabot stripper stops the sabot after firing, permitting the RAP to be propelled from the launcher.

An extractor is coupled to the breechblock. The extractor is configured to engage the housing of a cartridge located in the receiving area and to maintain or secure the housing during firing. When the breechblock is moved rearwardly, the housing is moved rearwardly as well into an extraction or ejection position.

In one embodiment, cartridges are stacked or stored in a cylindrical magazine inserted in the upper butt-stock region of the invention. The load follower is configured to load a cartridge from the magazine.

Further objects, features, and advantages of the present invention over the prior art will become apparent from the detailed description of the drawings which follows, when considered with the attached figures.

DETAILED DESCRIPTION OF THE INVENTION

The invention is a ring airfoil projectile launcher. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a launcher for launching ring airfoil projectiles. In a preferred embodiment, the launcher is of the repeating variety. The launcher is adapted to launch ring airfoil projectiles which are packaged in cartridge form.

Description of the Cartridge

Figure 1C:
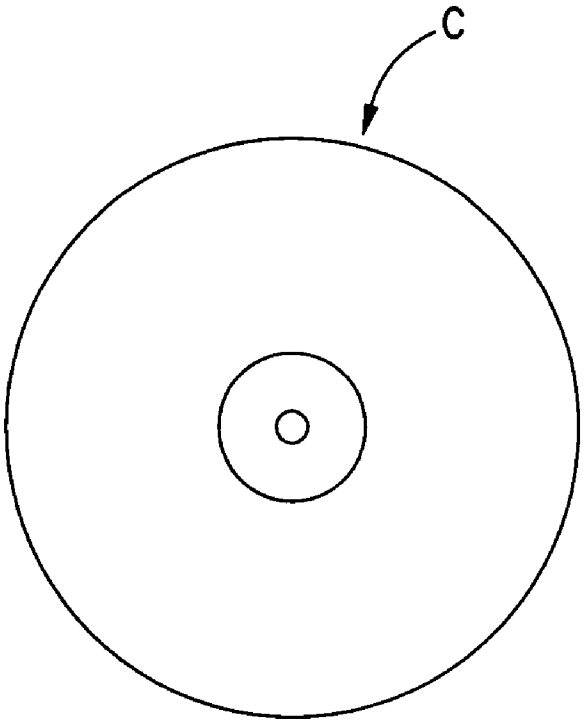
FIG. 1C is a view of the cartridge illustrated in FIG. 1A taken in the direction of arrow C.
Figure 1A:
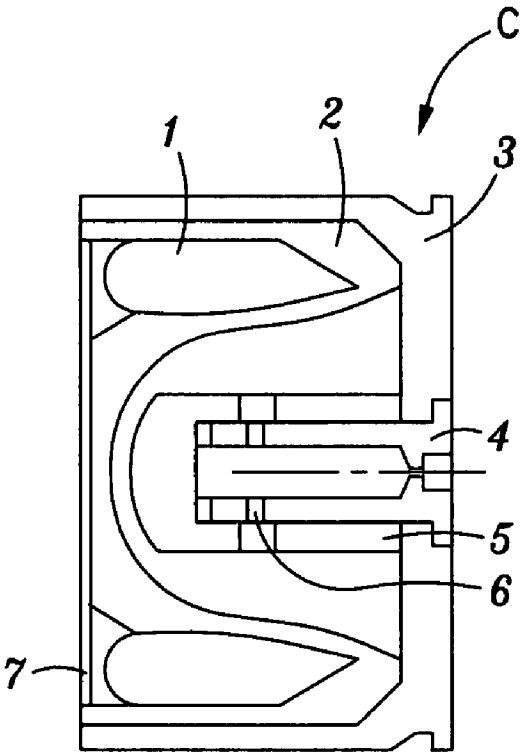
FIG. 1A is a cross-sectional side view of a cartridge in accordance with an embodiment of the invention.
Figure 1B:
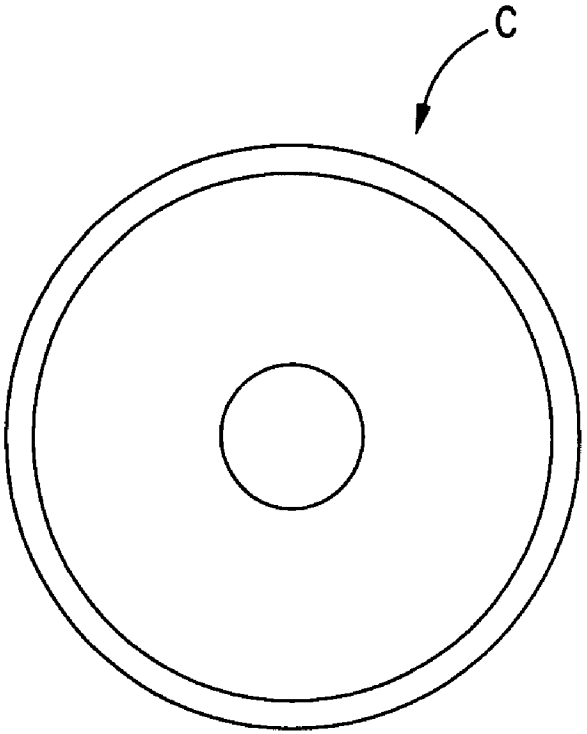
FIG. 1B is a view of the cartridge illustrated in FIG. 1A taken in the direction of arrow B.

The launcher of the invention may be utilized to launch ring airfoil projectiles associated with a variety of cartridges. FIGS. 1A-1C illustrate one embodiment of a cartridge (C).

In the embodiment illustrated, the overall shape of the cartridge (C) containing the ring airfoil is a disk or cylinder, having a central axis extending along a length thereof. In one embodiment, the cartridge (C) is unique because it has a diameter which exceeds its length (i.e. length to diameter ratio less than 1).

Referring to FIG. 1A, the cartridge (C) includes a ring airfoil projectile (1) shrouded in a sabot (2), with this assembly pressed into a case chassis or housing (3). The chassis or housing (3) also holds, along a central bore, a propulsion subsystem. This subsystem is an assembly of a high-pressure chamber (4) and a cap (5), which thread together from either side of the chassis or housing (3) along the central bore, thus clamping to it as shown in the Figure. The rear of the high-pressure chamber is provided with a primer pocket of a type standard in the art, which communicates to the explosion chamber by means of a flash-hole.

In operation, a standard primer in the pocket struck by a firing pin, provides heat and pressure that ignites a measured quantity of smokeless powder in the chamber (4). High-pressure gas builds up as the nearly closed construction of the high-pressure chamber facilitates the efficient combustion of the powder. A number of small vent holes (6) communicate the generated hot high-pressure gas to a low pressure chamber, where this gas then does the work of accelerating the sabot (2) with its ring airfoil (1) out of a mouth of the cartridge (C). A thin flap (7) is attached to the front of the sabot (2) for the purpose of protecting the ring airfoil (1) during cartridge (C) handling, and accelerates in place with this assembly.

Description of the Launcher

Figure 6:
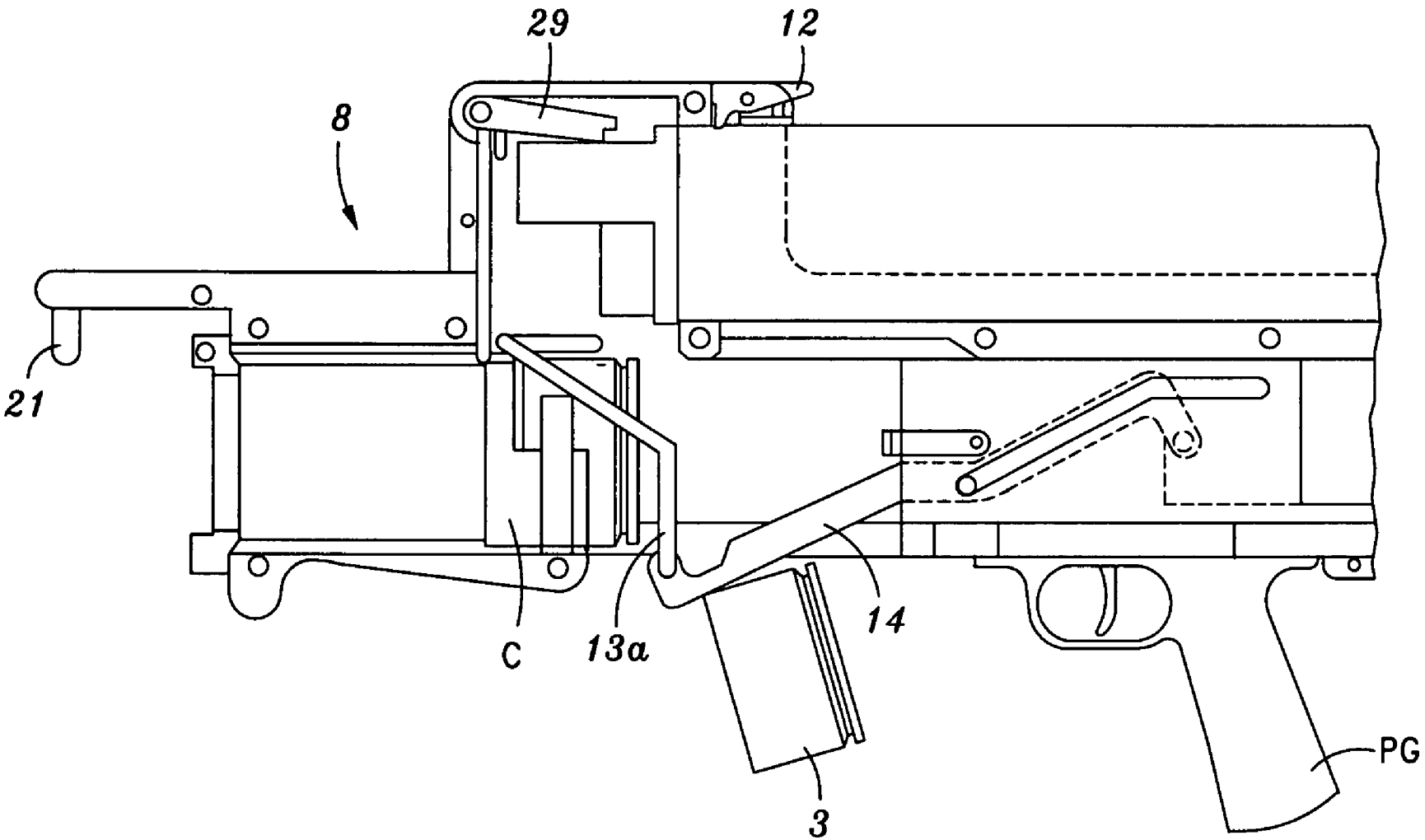
FIG. 6 is a view of the launcher illustrated in FIG. 5 after a housing of the fired cartridge has been ejected and a new cartridge loaded.
Figure 7:
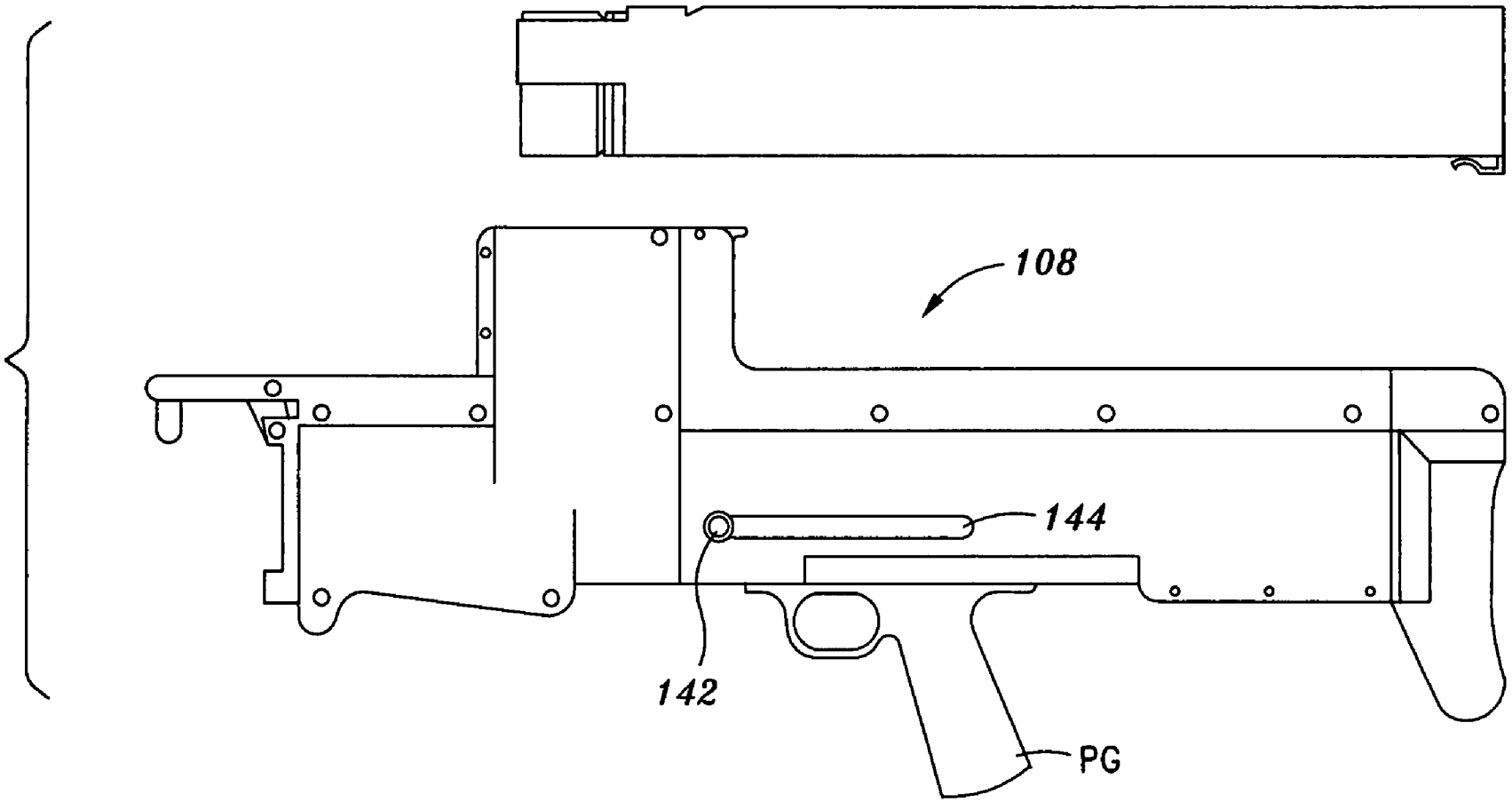
FIG. 7 is a side plan view of a semi-automatic launcher in accordance with another embodiment of the invention.
Figure 8:
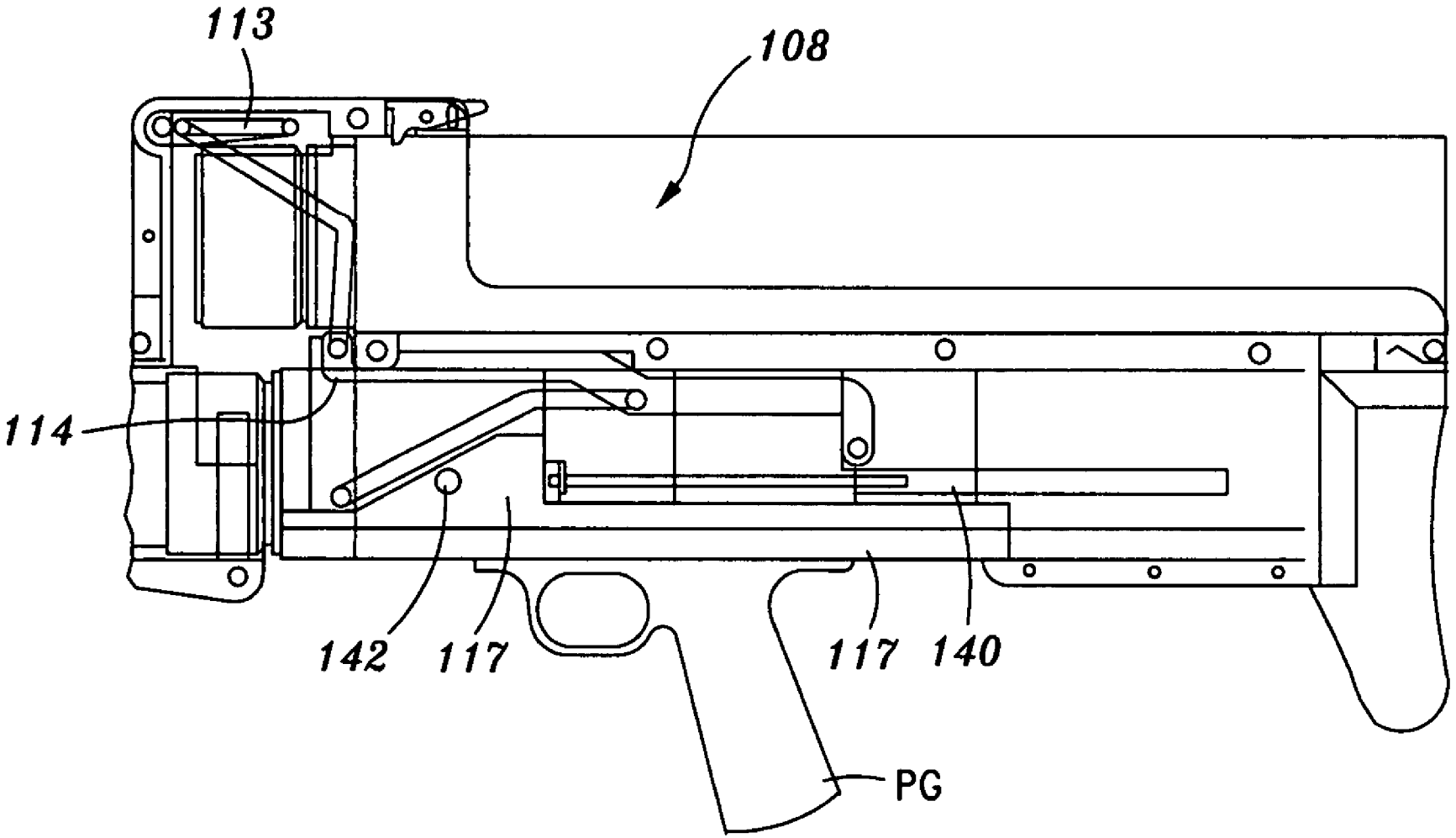
FIG. 8 is a partial cross-sectional view of the launcher illustrated in FIG. 7.

One embodiment of a launcher of the invention will be described with reference primarily to FIGS. 2-6. In general, in this embodiment, a multi-shot ring airfoil projectile launcher is described where cartridge loading and ejection facilitating firing of multiple ring airfoil projectiles is effected through manual operation. In particular, the cartridge loading and ejection is effected through manual "pumping" or "cocking" of a mechanism of the launcher. Another embodiment of a launcher, described primarily with reference to FIGS. 7 and 8, is semi-automatic. In this embodiment, cartridge loading and ejection is effected without this manual operation.

Figure 2:
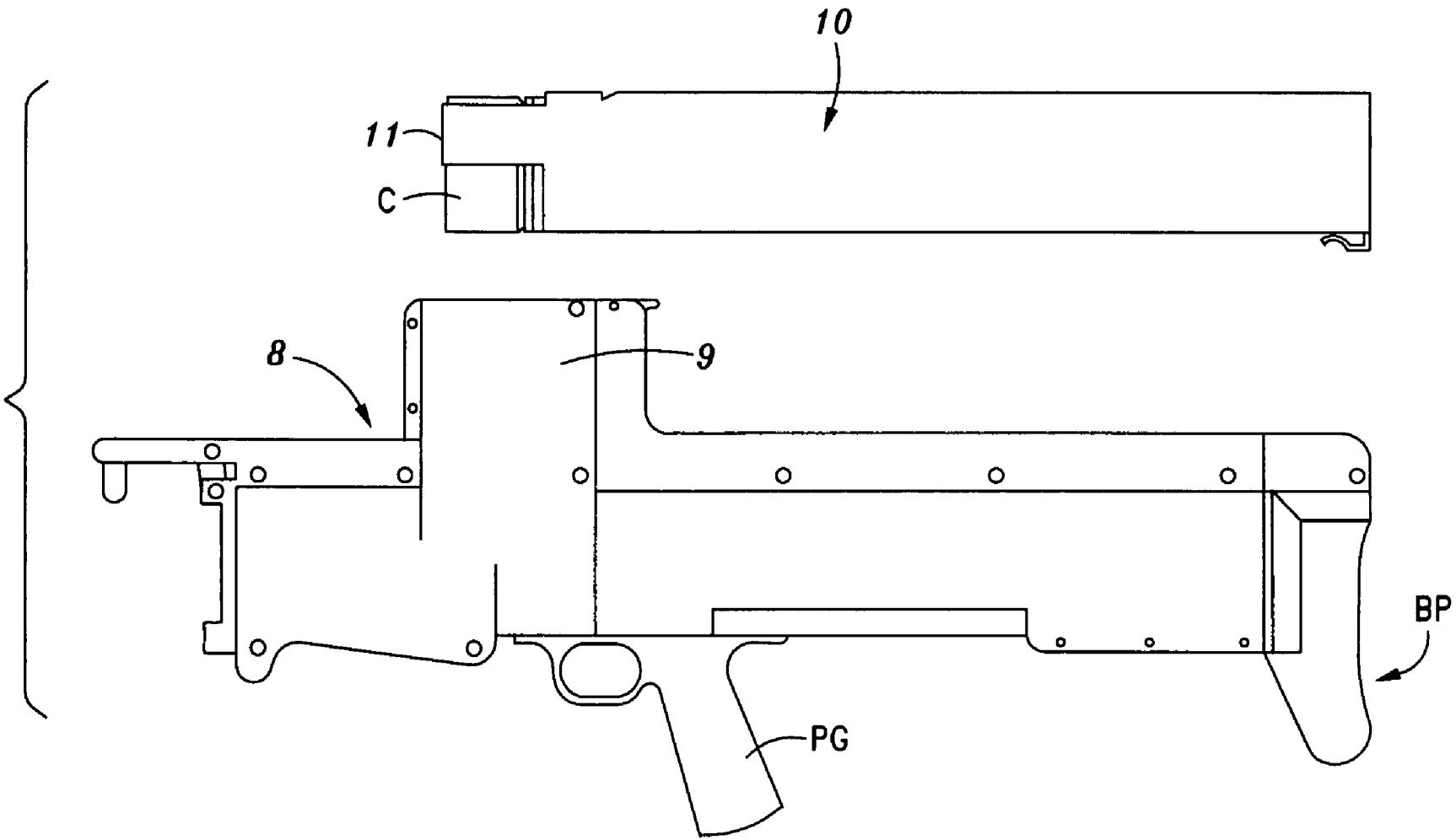
FIG. 2 is a plan view of a launcher and a cartridge magazine in accordance with an embodiment of the invention.

The exterior view of a launcher (8) in accordance with one embodiment of the invention is illustrated in FIG. 2. The launcher (8) generally comprises a body or receiver. The launcher (8) is seen to have a butt-stock pad (BP), a pistol grip (PG), and fore-arm grip, all designed to facilitate accurate aiming and firing from the offhand position. A central box-like structure is located between a barrel and the butt-stock (BP). This box-like structure is referred to herein as the receiver box (9). The receiver box (9) defines a cartridge receiving area. The barrel portion of the body defines a generally tubular passage through which a projectile is launched, the passage leading from the cartridge receiving area.

Above the launcher (8) is seen a detachable magazine (10). The magazine (10) is a long hollow cylinder fitted with a magazine spring and follower (not shown) standard in the art of magazine design. Up to eight ring-airfoil cartridges (C) may be stacked in the magazine (10), compressing the magazine spring, which provides the force to move the top cartridge (C) forward, to stop at the magazine lip (11).

In the embodiment of the invention illustrated, the cartridges (C) are stacked on top of each other (i.e. with their axis extending along a common axis through the magazine), as in the under-barrel tubular magazine of some long-gun designs, rather than side-by-side, as in a box magazine. This is the most compact and efficient way to store a disk-shaped cartridge for rapid deployment. This design also reduces, to a minimum, the silhouette of the launcher along all three dimensions, allowing for a repeater using a large cartridge to avoid cumbersome extensions or projections.

Figure 3:
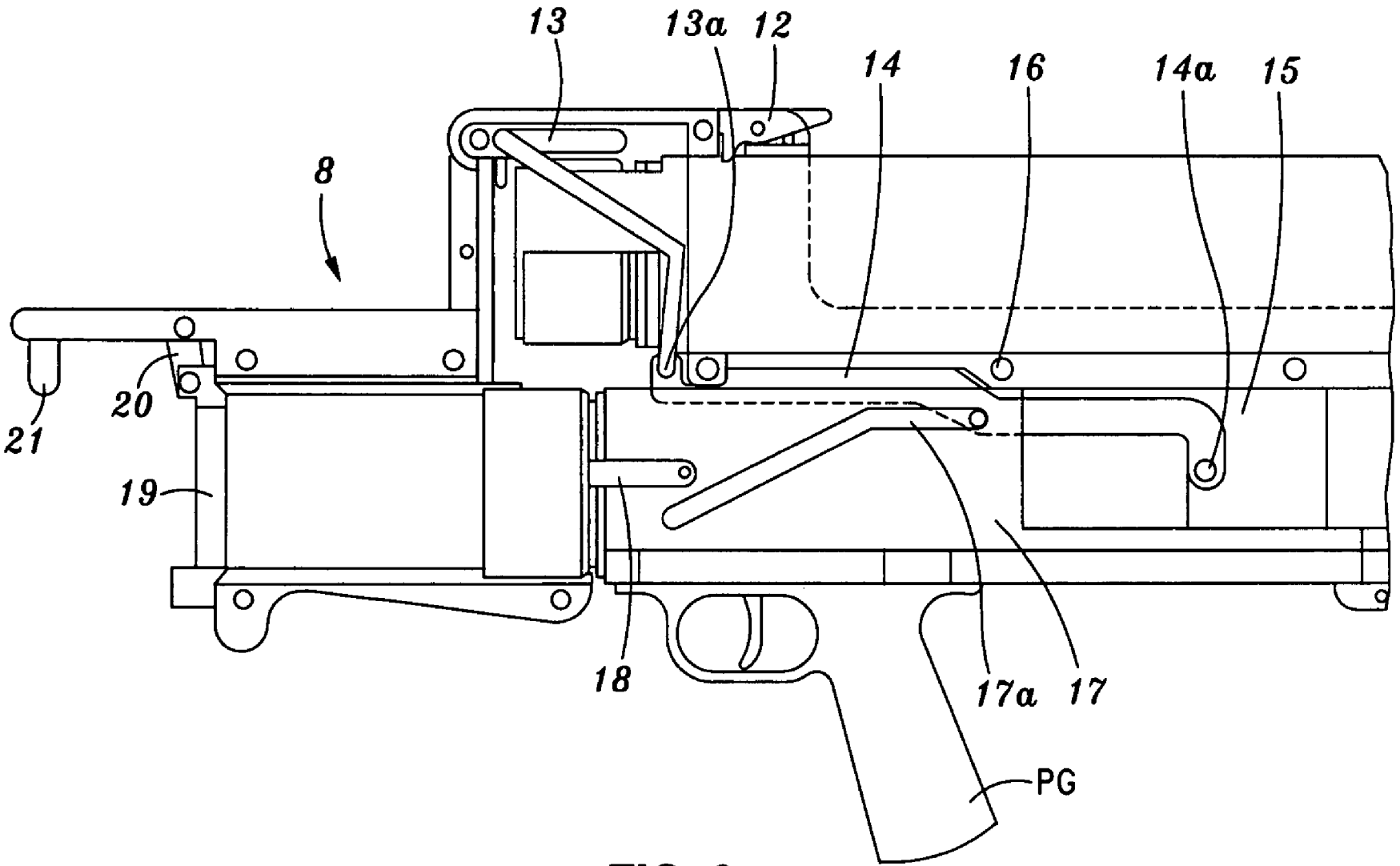
FIG. 3 is a side view, in partial cross-section, of a portion of the launcher illustrated in FIG. 2.

FIG. 3 shows a cut away view of the launcher (8) to explain the loading, extraction and ejection mechanism of the launcher (8). The magazine (10) is in place, locked to the launcher (8) by a small pivoting locking rachet (12) located at the top rear of the receiver-box (9). A loading-follower (13) is attached to an ejector-bar (14) by a pivot (13*a*). The ejector-bar (14) is itself pivoted (14*a*) to a stationary support (15) that is part of the rear of the butt-stock (BP). The ejector-bar (14) is provided with a cam-follower pin (16) which rides in the body of a breechblock (17) by means of a track (17*a*) cut into its outer walls. The breechblock (17) is moveable between forward and retracted positions in a chamber behind the cartridge receiving area. A cartridge (C) is shown in the chamber, supported by the breechblock (17). An extractor (18) is snapped over the rim of the cartridge (C). At the muzzle is shown a novel sabot-stripper (19) which is articulated on a link (20) and is provided with as sabot ejector (21). The sabot stripper (19) is a heavy metal ring whose center of mass is on the axis of the barrel, and has a reduced dimension compared to the passage through the barrel.

Figure 4:
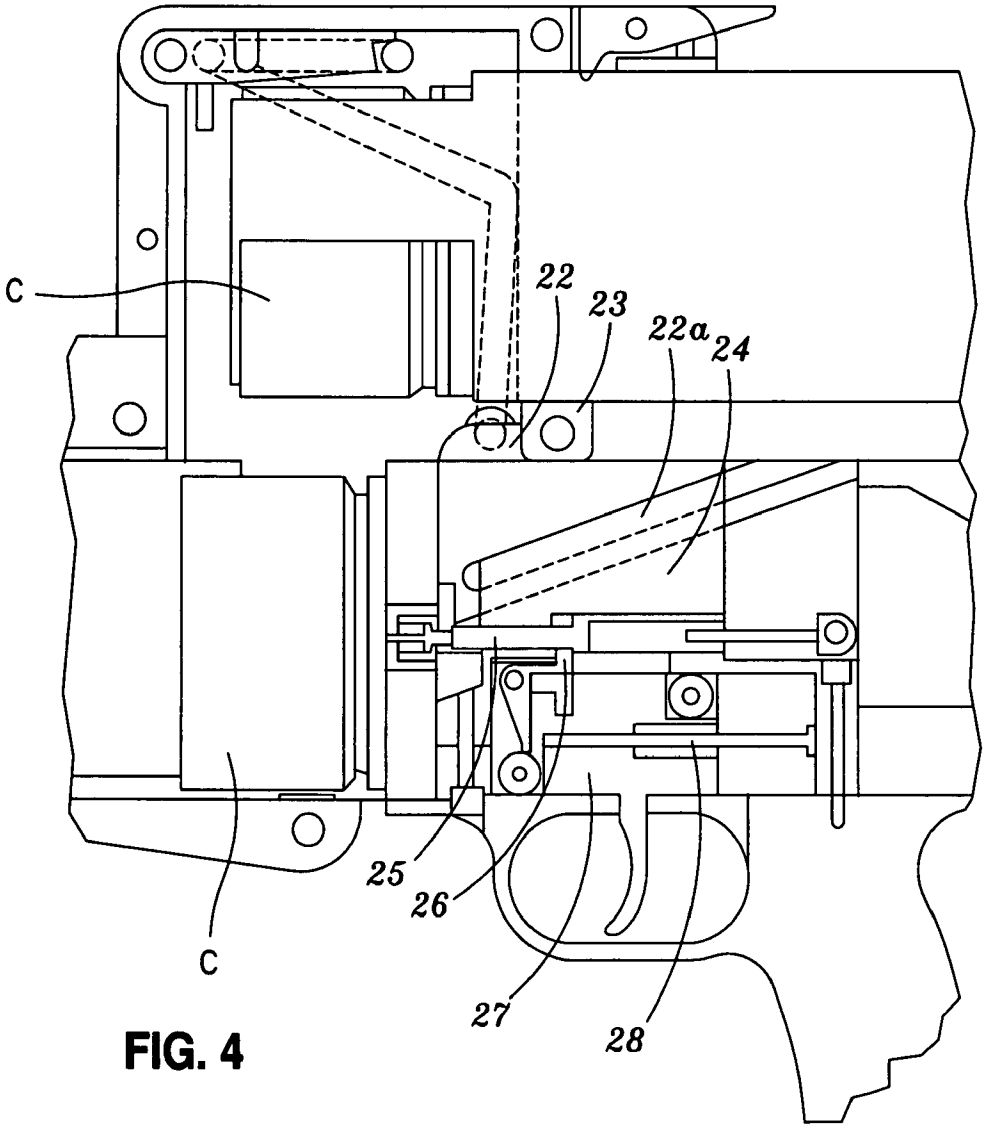
FIG. 4 is an enlarged cross-sectional view of a portion of the launcher illustrated in FIG. 2.

FIG. 4 is a detailed view of the locking mechanism and firing mechanism of the launcher (8). The lock (22) blocks rearward movement of the breechblock (17) after the breechblock has moved to a battery position, by moving upwards into the position shown. In this position, the lock (22) is seen to be pressed against the receiver-box block (23), acting as a deadbolt locking the breechblock (17) to the receiver. The breechblock (17) is connected to the pistol-grip (PG) through the lock (22) by means of canted railing (22*a*) cut into the lock (22). This railing (22*a*) matches a railing cut into a pistol-grip extension (24). The firing mechanism is a simple example of a trigger-pull cock-and-release device. The firing pin is a small captive pin thrust rearward by a small spring to present itself to a firing bolt (25). The firing bolt (25) is provided with a spring to thrust it forward. It is drawn rearward by a sear (26) which is pivoted on a trigger (27) and torqued by a spring to snap behind a ledge in the firing bolt. The trigger (27) is itself thrust forward by a trigger return spring. The sear is provided with a release pin (28) to cause detachment from the firing bolt at the end of the trigger travel.

Operation of the Firing and Stripping Mechanism

The launcher (8) is operated by aiming at the target and pulling back on the trigger (27), which, through the sear (26), draws the firing bolt (25) rearward. When the sear (26) has been drawn to a specified rear position, the release pin (28) contacts the sear (26) and causes it to pivot out of contact with the ledge of the firing bolt (25). When released, the firing bolt (25) accelerates toward the firing pin, striking it and driving it forward to impact the primer of the cartridge battery. As the cartridge functions as previously described, the firing pin spring drives the firing pin and firing bolt rearward, into the safety position. When the finger has relaxed, and the trigger return spring has pushed the trigger (27) full forward for the sear (26) to snap back into the ledge of the firing bolt, the mechanism is both safe from accidental firing by dropping the launcher (8) and ready for reiteration of the firing sequence.

Figure 5:
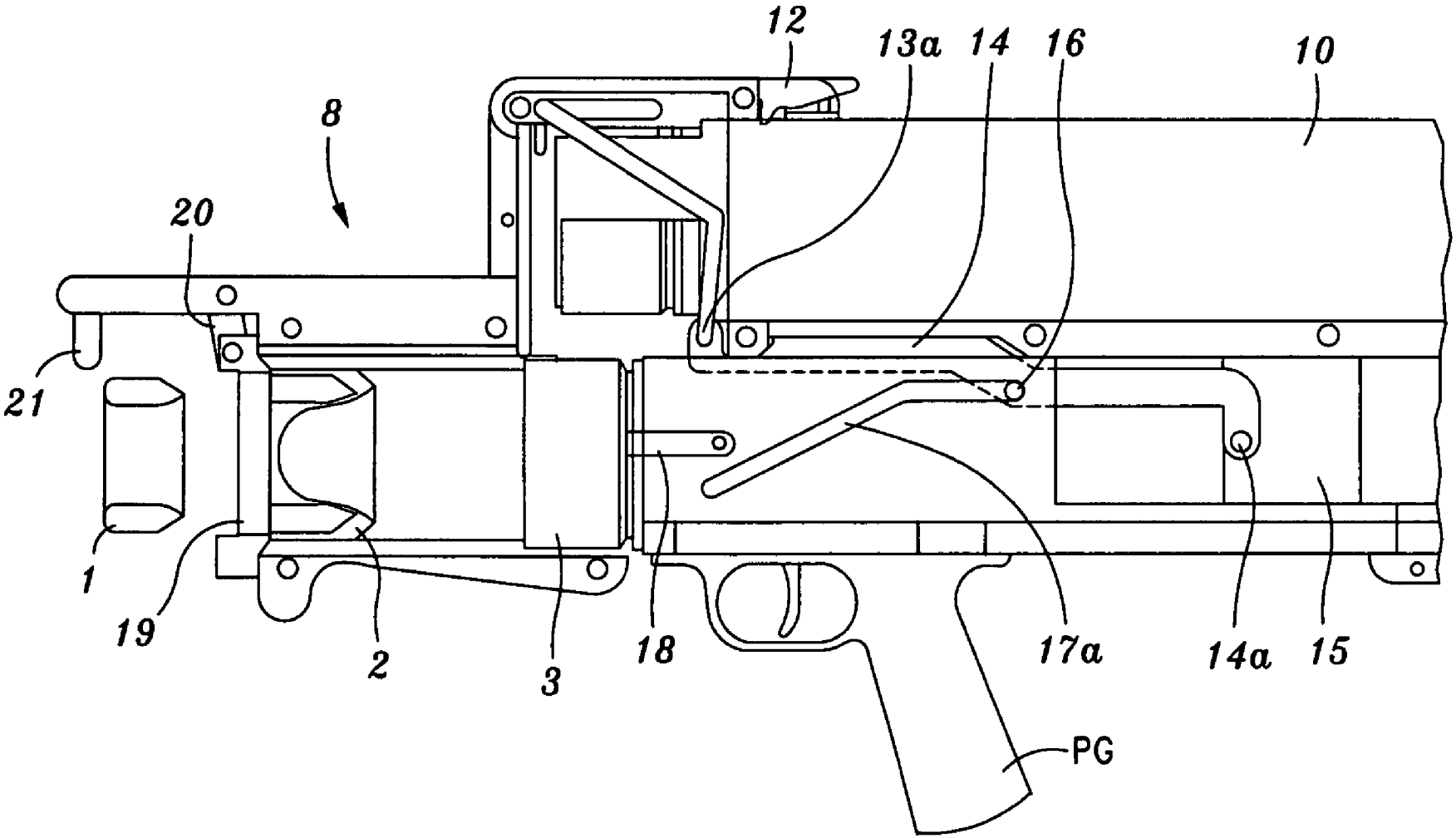
FIG. 5 is a view of the launcher illustrated in FIG. 2 after firing of a cartridge.

Referring to FIG. 5, as the cartridge (C) functions, the sabot (2) containing the ring-airfoil projectile (1) accelerates in the barrel to the specified speed, at which time the sabot (2) impacts the sabot-stripper (19). The sabot (2) is rapidly decelerated, causing the projectile to operate and travel forward at full speed. The combination of sabot (2) and the more massive sabot stripper (19) moves forward slowly. The link (20) allows the sabot stripper (19) to retain its on-bore orientation, as it moves slightly forward, during the time the ring airfoil moves past it. This minimizes disturbance to the airfoil as it clears the stripper (19). The stripper (19) and sabot (2) will continue forward under inertia plus residual gas pressure. The link will pull the stripper (19) off the bore axis and cause it to begin swinging upward causing the sabot (2) to slip from its initial contact. As the sabot (2) clears the muzzle, it will be deflected downward by the now angled stripper (19). If for some reason the sabot (2) adheres to the stripper (19), the sabot ejector (21) will release the sabot (2) by stopping its swiveling travel while the stripper (19) is allowed to swing upward another inch. Torsion springs on both pivots of the link (20) then cause the sabot stripper to return to its ready position at the muzzle.

Operating and Loading, Extraction, and Ejection Mechanisms

After the cartridge (C) in the chamber has been discharged, the preparation of the launcher (8) for another shot is accomplished by pulling the pistol-grip (PG) to the rear with the firing hand. Initial movement of a pistol-grip (PG) rearwardly will unlock the breechblock (17) by forcing the lock (22) downwardly in its recess between the breechblock (17) and the receiver-box block (23). This is done because the canted railing (22*a*) connecting the lock (22) to the pistol-grip (PG) must force the lock (22) to drop as long as it cannot move rearward pending the clearance of the receiver-box block (23). When the lock (22) has been forced downward sufficiently to clear the receiver-box block (23), the pistol grip (PG) reaches the end of its travel in the breechblock (17), and further pull rearward on the pistol-grip (PG) causes the breechblock (17) to move with it. The expended cartridge (C) is extracted from the chamber by a standard of the art spring-extractor, and drawn with the breechblock (17) rearward. After the breechblock (17) has moved one cartridge-length rearward, the cam-track cut into the outer walls of the breechblock (17) begins to pull the ejector-bar (14) downward. The ejector bar (14) pushes the spent cartridge (C) down and out of the grip of the extractor, and its attached loading-follower simultaneously pushes a cartridge (C) from the magazine (10), down into the chamber. As seen in FIG. 6, the cartridge-retainer (29) moves downward, upon release by the downward movement of the loading-follower (13), and stops the next cartridge (C) in the magazine (10) from the moving forward to the magazine lips. The mechanism has now reached its full rearward position. The spent cartridge (C) has cleared the launcher and the next cartridge is pre-positioned in the chamber.

The firing-hand now drives the pistol-grip (PG) forward. The force is transmitted through the lock (22) to the breechblock (17), driving it forward. As the breechblock (17) moves forward, its cam-track (17*a*) forces the ejector-bar (14) upward. The attached loading-follower (13) rises between the magazine lips until it contacts the cartridge-retainer (29). The cartridge-retainer (29) is pushed upward until the loading-follower (13) has cleared the top edge of the next cartridge (C) in the magazine (10), at which point the cartridge (C) is released and the magazine spring drives it forward to assume the full forward position in the magazine. After these events, the breechblock (17) travels forward the length of one cartridge (C) and arrives at its full forward position. Immediately prior to this, the cartridge (C) in the chamber is rammed half-an-inch forward to cause full objurgation between the cartridge-mouth and the breech, and the extractor (18) is snapped over the groove at the rear of the cartridge (C). The firing hand, still forcing the pistol-grip (PG) forward, now drives it one further inch, in which now forces the lock (22) upward as the canted railing (22*a*) of the pistol-grip extension moves forward. The lock (22), unable to move forward because it is in contact with the back wall of the breechblock (17), must ride upward into recess between the breechblock (17) and the receiver-box block (23), thus locking the breechblock (17) to the receiver. The launcher (8) is now fully in battery and ready to fire another cartridge (C). Note that the launcher (8) cannot be accidentally fired before the lock is fully engaged (launcher in battery) because the firing bolt, mounted in the pistol-grip (PG) extension cannot make contact with the firing pin until the extension is in its full forward, battery position.

Launcher Illustrated in FIGS. 7 and 8

Another embodiment of a launcher (108) in accordance with the invention will be described with reference to FIGS. 7 and 8. This embodiment launcher (108) is substantially similar to that illustrated in FIGS. 2-6. As such, like reference numerals have been assigned to like components or elements of this embodiment.

In this embodiment of the invention, the launcher (108) again includes a receiver or body. In this embodiment, however, the pistol grip (PG) is fixed to the receiver. The pistol grip (PG) may be located rearwardly of the forward-most position of the pistol grip of the launcher (8) described above. In one embodiment, the pistol grip (PG) is mounted approximately 2.5 inches rearward of this forward position of the grip in the other embodiment launcher (8).

This embodiment launcher (108) also does not include a bolt-lock (see lock (22) illustrated in FIG. 4 above). As described above, this permits movement of the breechblock (117) when a cartridge is fired.

In this embodiment, the launcher (108) the breechblock or bolt (117) is fitted with a forward driving spring or similar element. This spring may be situated in a spring hole (140) located behind the breechblock (117). Of course, other elements may be utilized to effect a return movement, as described below, of the breechblock (117).

A charging handle (142) extends outwardly from the breechblock (117). As illustrated in FIG. 7, the charging handle (142) extends through a generally horizontal or longitudinal slot (144) formed in the receiver.

Though not illustrated in detail, the launcher (108) includes a trigger mechanism associated with the pistol-grip (PG). The trigger may be actuated by a user. When actuated, the trigger operates a firing pin, causing a loaded cartridge to be fired. This firing mechanism may be substantially similar to that of the embodiment illustrated in FIGS. 2-6.

In use, a loaded cartridge is fired when the trigger is activated. The breechblock (117) is thrust backwards by gas pressure. The mass and other characteristics of the breechblock (117) are selected to control the speed attained by the breechblock (117) when exposed to the force resulting from this gas pressure.

When the breechblock (117) is moved rearwardly, the charging handle (142) moves rearwardly in the slot (144). An ejector-bar (114) is drawn downwardly, expelling the cartridge housing or casing in similar manner to that described above. At the same time, the loading-follower (113) draws the next cartridge downwardly into the loaded position.

The recoil spring then returns the breechblock (117) to the closed or loaded position, ready for firing. When this occurs, the charging handle (142) moves forward in its slot (144). Of course, after firing, the ring airfoil projectile is launched, with its sabot, as described above. Preferably, the sabot is stripped from the projectile as also described above.

It will thus be appreciated that in this embodiment of the invention, the loading of a new cartridge and ejection of the housing of a spent cartridge are accomplished in semi-automatic manner without the need of the user to "cock" or "pump" the breechblock (117).

It will be understood that the above described arrangements of apparatus and the method therefrom are merely illustrative of applications of the principles of this invention and many other embodiments and modifications may be made without departing from the spirit and scope of the invention as defined in the claims.

We claim:

1. A launcher for a ring airfoil projectile comprising a cartridge including a ring airfoil mounted to a sabot and a housing containing said ring airfoil and sabot, comprising:

a body defining a tubular passage having a first portion and a second portion, said first portion receiving said cartridge and said second portion including an end from which said ring airfoil is expelled;

an extractor adapted to contact said housing when said cartridge is located in said first portion of said passage and retain said housing of said cartridge upon firing of said ring airfoil projectile; and a sabot stripper located at said second portion of said launcher external to said end of said body, said sabot stripper comprising a generally hollow ring configured to permit a fired ring airfoil to pass therethrough but contact said sabot to separate said sabot from said ring airfoil at a point external to said body.

2. The launcher in accordance with claim 1 wherein said ring is rotatably mounted at said end.

3. The launcher in accordance with claim 2 wherein said ring is hingedly mounted at a top portion of said body adjacent said end.

4. The launcher in accordance with claim 1 including a sabot ejector configured to separate said sabot from said sabot stripper.

5. The launcher in accordance with claim 4 wherein said sabot stripper is configured to move between a first position in which is aligned with said tubular passage at said end and a second position in which it is rotated upwardly away from said end, and wherein sabot ejector comprises a member extending outwardly and configured to contact said sabot when said sabot stripper is in said second position.

6. The launcher in accordance with claim 1 wherein said launcher includes a breechblock movably mounted in said body, said extractor extending from said breechblock.

7. The launcher in accordance with claim 1 wherein said housing defines at least one groove in an exterior surface thereof and said extractor is configured to engage said groove.

8. The launcher in accordance with claim 1 including an ejector configured to eject said retained housing from said body.

9. The launcher in accordance with claim 8 wherein said ejector comprises a bar movable into a position in which it is positioned in said tubular passage, forcing said housing from said passage.

10. The launcher in accordance with claim 9 wherein said body includes an ejection opening located therein and leading to said tubular passage, through which said housing is ejected.

11. A launcher for a ring airfoil projectile comprising a cartridge including a ring airfoil mounted to a sabot and a housing containing said ring airfoil and sabot, comprising:

a body defining a tubular passage having a first portion and a second portion, said first portion receiving said cartridge and said second portion including an end from which said ring airfoil is expelled;

an extractor adapted to contact said housing when said cartridge is located in said first portion of said passage and retain said housing of said cartridge upon firing of said ring airfoil projectile;

a breechblock movably mounted in said body, said extractor extending from said breechblock; and a sabot stripper located at said second portion of said launcher configured to permit a fired ring airfoil to pass therethrough but contact said sabot to separate said sabot from said ring airfoil.

12. The launcher in accordance with claim 11 wherein said sabot stripper comprises a ring hinged at said end of said body.

13. The launcher in accordance with claim 11 wherein said breechblock may be moved from a forward to a retracted position.

14. The launcher in accordance with claim 13 wherein said breechblock is connected to a user-engageable grip.

15. A launcher for a ring airfoil projectile comprising a cartridge including a ring airfoil mounted to a sabot and a housing containing said ring airfoil and sabot, comprising:

a body defining a tubular passage having a first portion and a second portion, said first portion receiving said cartridge and said second portion including an end from which said ring airfoil is expelled;

an extractor adapted to contact said housing when said cartridge is located in said first portion of said passage and retain said housing of said cartridge upon firing of said ring airfoil projectile;

an ejector comprising a bar movable into a position in which it is positioned in said tubular passage, forcing said housing from said passage;

an ejection opening in said body leading from said tubular passage through which said housing is ejected by said ejector; and a sabot stripper located at said second portion of said launcher, said sabot stripper configured to permit a fired ring airfoil to pass therethrough but contact said sabot to separate said sabot from said ring airfoil.

* * * * *